US005170690A

United States Patent [19]

Smirlock et al.

[11] Patent Number: 5,170,690

[45] Date of Patent: Dec. 15, 1992

[54] SURVIVABILITY ENHANCEMENT

[75] Inventors: Martin E. Smirlock, Concord; William A. Ribich, Lexington; Paul J. Marinaccio, East Orleans, all of Mass.; Bernard E. Sawaf, Nashua, N.H.

[73] Assignee: Foster-Miller, Inc., Waltham, Mass.

[21] Appl. No.: 529,196

[22] Filed: May 25, 1990

Related U.S. Application Data

[63] Continuation-in-part of Ser. No. 202,218, Jun. 3, 1988, Pat. No. 4,928,575.

[51] Int. Cl.[5] ..... F41H 7/02

[52] U.S. Cl. ..... 89/36.08; 89/36.02

[58] Field of Search ..... 89/36.02, 36.01, 36.08, 89/36.13; 428/911

[56] References Cited

U.S. PATENT DOCUMENTS

| | | | |
|---|---|---|---|
| 678,064 | 7/1901 | Theis | 89/36.02 |
| 1,913,168 | 6/1933 | Longenecker . | |
| 2,717,437 | 9/1955 | de Mestral | 428/92 |
| 2,789,076 | 4/1957 | Frieder et al. | 428/911 |
| 3,216,166 | 11/1965 | Brown . | |
| 3,349,397 | 10/1967 | Rosenthal | 342/3 |
| 3,500,773 | 3/1970 | Pfaff et al. | 89/36.02 |
| 3,624,749 | 11/1971 | Girard et al. . | |
| 3,708,833 | 1/1973 | Ribich et al. | 24/204 |
| 3,863,412 | 2/1975 | Bodycomb et al. | 52/483 |
| 3,916,703 | 11/1975 | Ribich et al. | 24/204 |
| 4,028,859 | 6/1977 | Bellagamba | 52/393 |
| 4,167,889 | 9/1979 | Bohne et al. | 89/36.02 |
| 4,169,303 | 10/1979 | Lemelson | 24/204 |
| 4,391,178 | 7/1983 | Pagano | 89/36.02 |
| 4,497,069 | 2/1985 | Braunhut | 2/236 |
| 4,545,286 | 10/1985 | Fedij | 89/36.02 |
| 4,559,251 | 12/1985 | Wachi | 428/911 |
| 4,635,418 | 1/1987 | Hobgood | 52/239 |
| 4,709,453 | 12/1987 | Harvey et al. | 24/442 |
| 4,713,275 | 12/1987 | Riccitiello et al. | 428/76 |
| 4,824,624 | 4/1989 | Palicka | 89/36.02 |

FOREIGN PATENT DOCUMENTS

| | | | |
|---|---|---|---|
| 0041271 | 12/1981 | European Pat. Off. . | |
| 0226265 | 6/1987 | European Pat. Off. . | |
| 1168622 | 4/1964 | Fed. Rep. of Germany . | |
| 2621999 | 12/1977 | Fed. Rep. of Germany . | |
| 322582 | 8/1936 | Italy | 89/36.02 |
| 488420 | 12/1953 | Italy . | |
| 68019 | 2/1914 | Switzerland . | |
| 2007256 | 5/1979 | United Kingdom . | |

OTHER PUBLICATIONS

The Dow Chemical Company, *Advanced Materials and Technology Brochure.*

*Primary Examiner*—Stephen M. Johnson
*Attorney, Agent, or Firm*—Fish & Richardson

[57] ABSTRACT

A survivability enhancement system includes first separable fastener structure fixed on the surface of the vehicle or system whose survivability is to be enhanced, and an array of armor tiles. The armor tiles provide a composite supplementary layer of armor that maintains attachment at effective levels even as armor tiles are subjected to large shear forces (for example, upon ballistic impact and shattering of an adjacent tile) and that has effective force dissipation characteristics. Each armor tile has opposed surfaces with second separable fastener structure complementary to the first separable fastener structure secured to one of its surfaces, one of the separable fastener structures having a multiplicity of projecting hooking elements and the cooperating fastener structure having complementary structure that is releasably interengageable with the hooking elements.

10 Claims, 4 Drawing Sheets

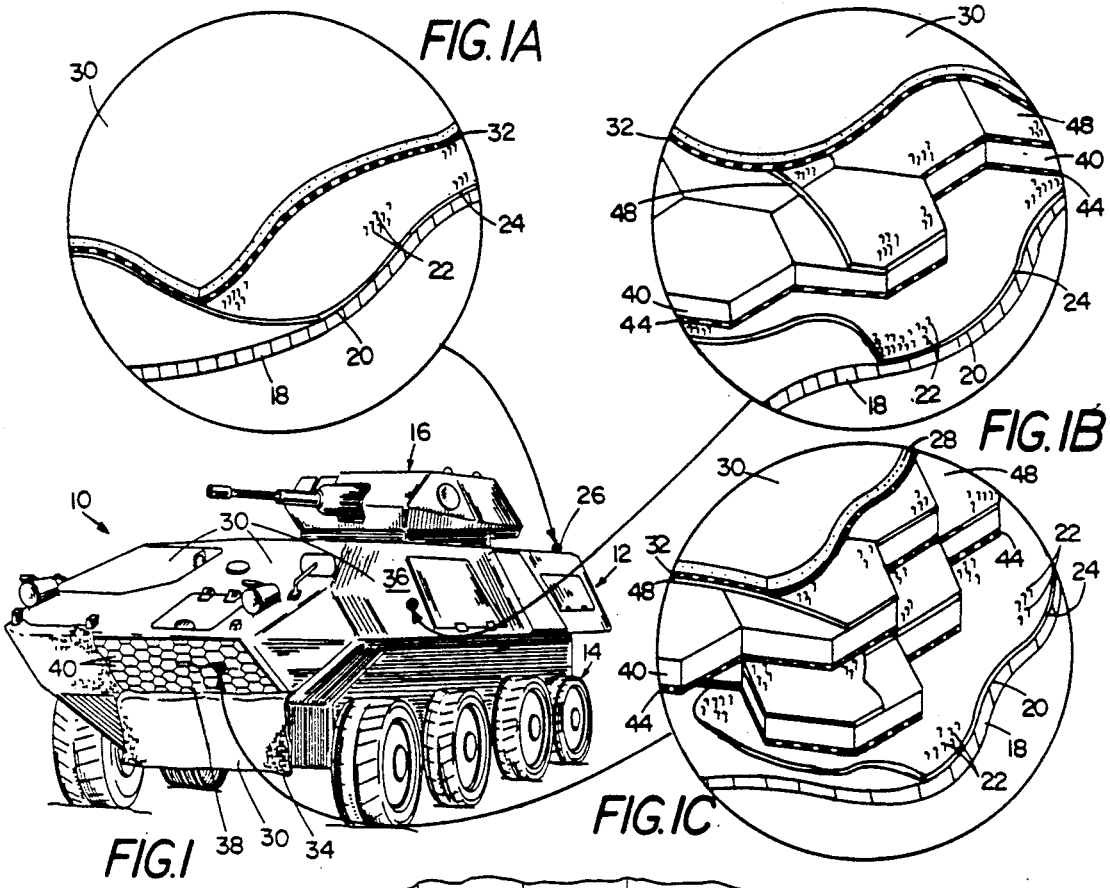
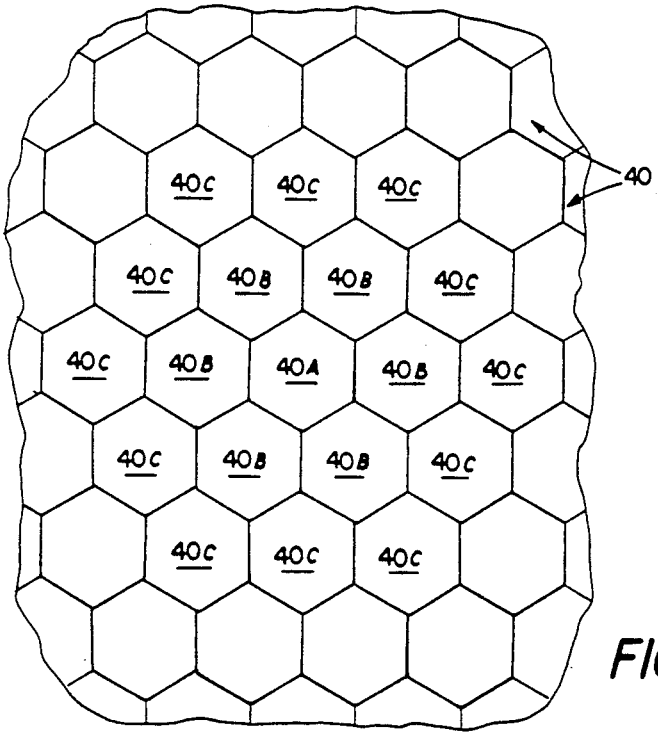
FIG. 2

SURVIVABILITY ENHANCEMENT

CROSS-REFERENCE TO RELATED APPLICATION

This is a continuation-in-part of our prior copending application Ser. No. 202,218 filed Jun. 3, 1988 now U.S. Pat. No. 4,928,575.

BACKGROUND OF THE INVENTION

This invention relates to survivability enhancement. It is frequently desirable to enhance the survivability of various structures, including fixed and movable structures, and, depending on particular applications, survivability enhancement structure may be placed on internal or external surfaces, or both of the structure whose survivability it is desired to enhance.

In particular applications, survivability enhancement structures are applied to external surfaces of the vehicle or system. Armored vehicles, for example, are designed to provide ballistic protection commensurate with a specific threat. In connection with such vehicles and systems, the ability to readily vary the ballistic protection configuration or to quickly repair damaged armor as a function of particular threats to which the vehicle or system may be exposed may enhance survivability. Further, arrangements which reduce vehicle "signature" (as a function of electromagnetic radiation, infrared radiation, or the like) may also enhance survivability. The appearance of new vehicle armor in the field stimulates the development of new munitions with enhanced capability to defeat the newly fielded armor. Applique armor, that is, supplemental armor applied on top of the basic armor designed into the vehicle or system, has been proposed to enhance survivability. It has been proposed to attach such applique armor to the basic armor by adhesive bonding, by mechanical bolting and by magnetic attachment.

Other survivability enhancement structures may be placed on internal surfaces of preexisting structures for enhanced ballistic protection or the like. An example of such a survivability enhancement structure is a liner to capture spall, that is material that flies out of the interior surface of a wall structure when a shock wave propagates through the wall. When the compressive shock wave travels through the wall material, it eventually reaches the interior surface (the side furthest from the attack). If the wall material has a free face or is in contact with another material with very different physical properties (e.g. density, sound propagation velocity, etc.) the shock wave will reflect and cause tensile forces to be created which, if they exceed the ultimate strength of the wall material, cause pieces of the wall material to fly off in the direction of travel of the compressive wave. These pieces can travel at high speed and become lethal projectiles in and of themselves. Spall liners (frequently made of high tensile strength fibrous material (aramid (Kevlar), polyethylene (Spectra), Nylon, etc.)) may be of single ply, or quilted into a multi-ply "blanket" and hung in place, much like a curtain, or bolted in place.

In the bolted case, the spall liner is rigidly attached and the mechanism of absorption of the kinetic energy of the flying spall is delamination (inter-laminar shear) and subsequent inter-fiber or fiber-matrix frictional dissipation. If the delamination process fails to occur, and if the kinetic energy is high enough relative to the projected area of the projectiles, "punch-through" will occur and the lethality of the projectile will not be reduced substantially. Similarly, if the rigid spall liner structure is bonded or glued in place, the existing structure to which it is bonded provides reinforcement against deflection, increases the required inter-laminar shear forces necessary for the onset of delamination and consequently reduces the overall ballistic performance of the liner (increases the likelihood of punch-through).

SUMMARY OF THE INVENTION

In accordance with one aspect of the invention, there is provided a survivability enhancement system that has energy absorbing and progressive energy dissipation characteristics. The survivability enhancement system includes separable fastener structure of a first type fixed on a surface of the structure whose survivability is to be enhanced, survivability enhancement structure that has a complementary surface corresponding to the structure surface, and separable fastener structure of a second type and complementary to the first type of separable fastener structure secured to the survivability enhancement structure. The separable fastener structures, in attached relation, support the survivability enhancement structure on the structure surface, and preferably have a tension restraint of at least five psi and a shear restraint of at least ten psi.

In preferred embodiments, the survivability enhancement system includes first separable fastener structure fixed on surface structure of the vehicle or system whose survivability is to be enhanced, and survivability enhancement armor structure with second separable fastener structure complementary to the first separable fastener structure secured thereon, one of the separable fastener structures has a multiplicity of projecting hooking elements (for example, of the hook or spear type) and the cooperating other fastener structure has complementary structure that is releasably interengageable with the hooking elements. Depending on the particular application, the hooking element structure may be on the survivability enhancement structure or on the structure whose survivability is to be enhanced.

Particular survivability enhancement structures include one or more flexible ballistic protection members (in the nature of spall liners) that carry separable fastener structure for mounting on an interior wall of a structure whose survivability is to be enhanced; survivability enhancing armor laminate sheets disposed in a stacked arrangement that carries separable fastener structure for mounting on an interior wall of a structure whose survivability is to be enhanced; and an array of armor tiles for disposition on an exterior wall of a structure whose survivability is to be enhanced, each armor tile carrying separable fastener structure and having perimeter surface portions for mating juxtaposition with perimeter surface portions of adjacent armor tiles to provide a composite supplementary layer of armor. The separable fastener attachment structures in each embodiment have effective force dissipation characteristics and maintain attachment at effective levels even as the survivability enhancement structure is subjected to large shear forces (for example, upon ballistic impact and shattering of an adjacent tile or flexing of an armor sheet member).

In particular embodiments, the survivability enhancement system includes flexible cover or container structure with separable fastener structure of the second type secured to a surface of the flexible structure for fastening interengagement with separable fastener structure of the first type. The flexible structure may include signature reduction characteristics (in terms of electromagnetic radiation, infrared radiation or the like, as appropriate) and in one particular embodiment is of silicone rubber material with embedded particulate signal reduction material. While the survivability enhancement structure may be of various materials, including high tensile strength fibrous materials, metals and reactive (e.g., explosive) materials, in particular embodiments the survivability enhancement material is a ceramic armor material such as boron carbide, silicon carbide, aluminum oxide, titanium diboride, or the like. In such particular embodiments, each ceramic armor member preferably has opposed planar surfaces and is at least about one centimeter thick and is of polygon configuration with perimeter edge surfaces at least about four centimeters long. In one particular embodiment, separable fastener structure of the first type is bonded to one planar surface of the armor member and separable fastener structure of the second type is bonded to its opposed planar surface; while in other particular embodiments, one or both of the separable fastener structures is secured with high tensile strength fibers (as by stitching) to the survivability enhancement armor structure and/or to the structure whose survivability is to be enhanced.

Survivability enhancement systems in accordance with the invention enable easy installation of auxiliary armor structure, as well as easy removal and reapplication to facilitate future armor revisions and upgrades. No alterations or modifications of the basic structure of the vehicle or other structure are required, nor does the survivability enhancement system degrade the structural integrity of the basic system structure. Easy replacement of damaged survivability enhancement members in the field is possible. Interactions between adjacent armor members and between the armor structure and the base system structure are such that destructive impact of a projectile on one armor member results in minimal damage and or displacement of adjacent armor members. The structural integrity of the attachment system withstands normal system shocks, vibrations, brush loads, etc. Supplementary survivability enhancement members may be stored or transported separately from the vehicle or system for application in the field when enhanced armor is desired and may be selectively applied to selected portions of the vehicle or system, thus enhancing the versatility thereof.

Enhanced spall liner performance may be obtained by attaching a flexible fibrous-type spall liner to the existing structure with fastener structure that is essentially continuous over the surface (like adhesive) but which releases at a controlled force level, that is, near to, but less than, the force that causes failure of the fibers in the liner so that the liner can contain the spall while kinetic energy is absorbed by the successive release of the fastener elements rather than rupture of the liner. After the event, the majority of the fastener elements can be easily re-engaged so that the integrity of the system is restored to protect against a second event.

In another system, an armor system that mounts internally to an existing structure or vehicle is a composite of a hard projectile defeating material (e.g., ceramic, steel, etc.) and is attached internally in appropriately optimized size and shape pieces. The separable fastener hook and loop system absorbs projectile energy and its partial release characteristics dissipate energy imparted to the armor through momentum transfer from the projectile.

This same concept can be utilized to manage energy between layers in a composite structure during a ballistic penetration attempt. The principal mechanism of defeat of a projectile by thick section composite (2D lay-up of S2-glass and polyester) is through failure of the matrix material and subsequent delamination. Multiple thin layers assembled through mating surfaces of separable fastener hook and loop systems enable tailoring of the energy absorption of each layer, much like multiple spall liners behave. The separable fastener system is designed so that individual layers (or plies) can shift position relative to one another, absorbing energy in the process such that the tensile forces in the fibers that make up the plies do not exceed their ultimate limits, and the projectile does not "punch-through".

In still another embodiment, blast confinement structure is fashioned out of spirally-rolled sheet material. One surface is covered with hook-type separable fastener structure and the opposite surface with loop-type separable fastener structure. When the sheet material is rolled the two surfaces mate. A blast loading internal to the container structure causes a step increase in hoop stress and the effective radius of curvature of the blast confinement structure increases, and the two mated surfaces tend to interact in shear. The hoop stress, if greater than the ultimate yield of the separable fastener treated surfaces, causes opposed movement of the surfaces. This results in an increase in the diameter along with substantial dissipation of blast energy. The increase in the diameter/volume also has a mitigating effect on the load. Movement and energy absorption of the separable fastener treated surfaces continue until such time as the forces balance, thus confining the blast, albeit with a potential change in size of the container.

Preferably, each hooking element includes a flexible stem portion and a head portion, the head portion including a laterally-projecting inclined deflecting portion and a latch surface located between the deflecting surface portion and the stem portion for engaging a portion of the cooperating fastener structure in fastening relation. While the fastener elements may be of a variety of materials, including metals, in particular embodiments, the base portion and hook elements are of thermoplastic polymeric material such as nylon, polypropylene or the like, and the base portion of the fastener structure is bonded with epoxy or the like to the surface on which it is secured. In particular embodiments, the cooperating fastener structure includes a multiplicity of loop elements which may be formed from relatively long lengths of continuous fiber, the loop elements not being fixed, as with cement to the backing material, such that the loop structure absorbs relatively large amounts of energy as the loop fibers are pulled through their backing materials, resulting in significant increases in peel strength.

Other features and advantages of the invention will be seen as the following description of particular embodiments progresses, in conjuction with the drawings.

BRIEF DESCRIPTION OF THE DRAWING

FIG. 1 is a view of a light armored vehicle that incorporates survivability enhancement in accordance with the invention, the enlarged views of FIGS. 1A, 1B and 1C illustrating particular configurations of survivability enhancement systems in accordance with the invention;

FIG. 2 is an elevational view of an array of armor tiles in accordance, with the invention;

DESCRIPTION OF PARTICULAR EMBODIMENTS

Figure 3:
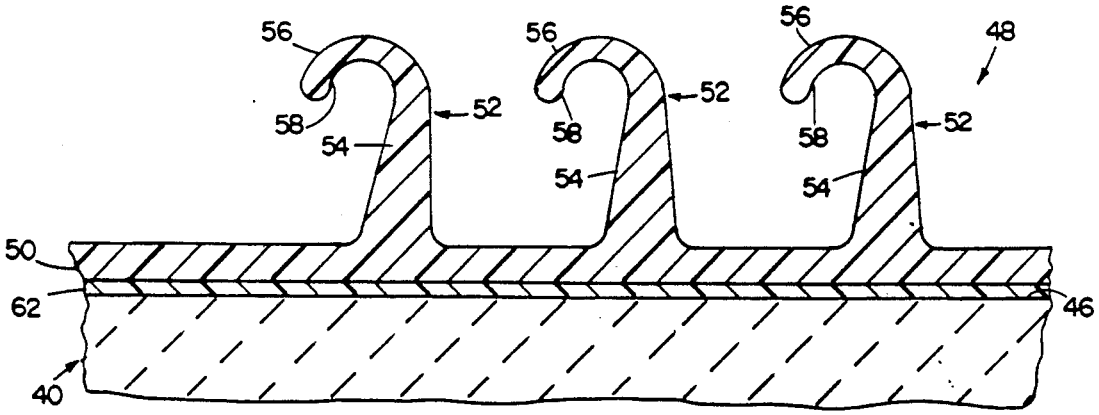
FIG. 3 is a sectional diagrammatic view of a portion of an armor tile in accordance with the invention.

Shown in FIG. 1 is a lightweight high mobility vehicle 10 that includes hull 12 mounted on a series of driven wheels 14, and turret 16 on hull 12. Hull 12 is constructed of one quarter inch thick steel armor plate 18 and has fastener structure 20 on the outer surface of the steel hull. Structure 20 includes an array of upstanding hook elements 22 that ar integral with base 24 and formed of injection-molded nylon, with base portion 24 secured to the surface of armor 18 with epoxy or other suitable adhesive. Hooks 22 have a height of about four millimeters, are flexible and facilitate resilient interengagement and disengagement with complementary structure of a cooperating separable fastener component.

Overlying fastener structure 20 is flexible cover sheet 30 which provides signature reduction (such as modified reflectivity to electromagnetic radiation, infrared radiation, or the like). Cover sheet 30 includes a silicone rubber substrate in which particulate signal reduction material 28 is embedded, sheet 30 having a thickness of about six millimeters. Secured on the inner surface of cover 30 by a suitable adhesive is fastener structure 32 which includes an array of loop elements 34 of polymeric material, the loops having heights of about three millimeters.

Figure 4:
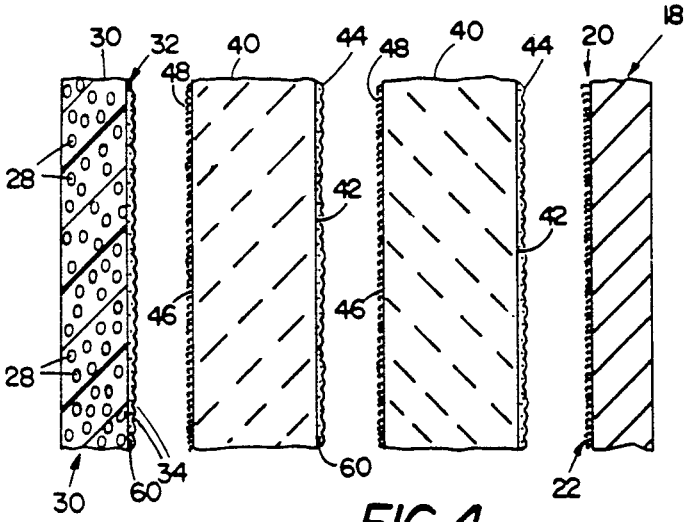
FIG. 4 is a sectional diagrammatic view of portions of components of the survivability enhancement system of FIG. 1 in spaced-apart relation.

Hook elements 22 of fastener structure 20 may be engaged with loop elements 34 of cover 30 in top region 26 as indicated in FIG. 1A. In other locations of the hull 12, one or more layers of ceramic armor tiles 40 may be interposed between hull 12 and cover 30, a single layer of armor tile 40 being provided in side region 36 as indicated in FIG. 1B and a double layer of armor tile 40 being provided in front region 38 as indicated in FIG. 1C. Each ceramic tile 40 is of boron carbide of about two centimeters thickness and has a hexagonal configuration with the straight edge sections of the perimeter having a length of about eight centimeters. As indicated in FIG. 4, secured on planar surface 42 of each tile 40 is separable fastener structure 44 similar to cover fastener structure 32, and secured on opposite surface 46 is separable fastener structure 48 of the hooking type similar to hull fastener structure 20. A portion of an array of armor tiles 40 secured on armor plate 18 is diagrammatically shown in FIG. 2.

As indicated in FIG. 3, fastener structure 48 includes base portion 50 and an array of hook elements 52, each of which includes flexible stem portion 54, deflection surface 56, and latch surface 58. It will be apparent that other hooking element configurations (of arrow or spear shape, for example) may be employed. Hooking elements 22 of the separable fastener structure 20 secured to hull 12 are of similar configuration. Cooperating separable fastener structures 32, 44 include nylon filament or metal wire loops 34 secured to base sheet 60. Separable fastener structures 44, 48 are secured to armor tile 40 with bonding agents 62.

Figure 5:
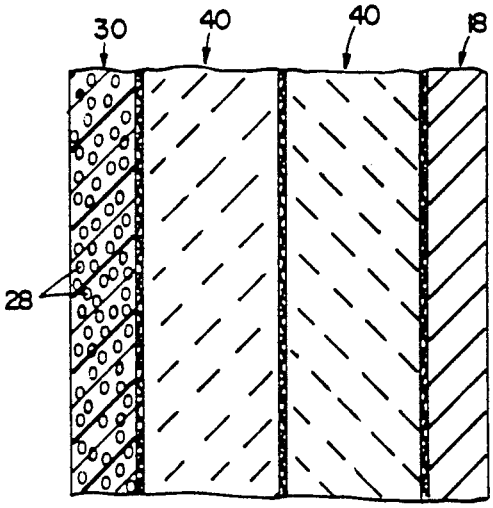
FIG. 5 is a similar diagrammatic view of the components of the survivability enhancement system of FIG. 4 in fastened relation.

Shown in FIGS. 4 and 5 are diagrammatic sectional views of components of the survivability enhancement system, the components being shown in spaced apart relation in FIG. 4 and in fastened relation in FIG. 5.

The holding force of the survivability enhancement fastener system is a function of the configuration, density and material of the hook elements 22, (52) as well as the size, number and material of loops 34. In a particular embodiment, the fastener structures 22, 34, in attached relation, have a tension restraint of about seven psi or a total of 180 pounds over the 26-square inch area of an individual tile 40; and a shear restraint of approximately fifteen psi or a total of 390 pounds for the 26-square inch area of a tile 40. The fastener arrangement provides compliance and compression force absorbance characteristics.

Figure 6:
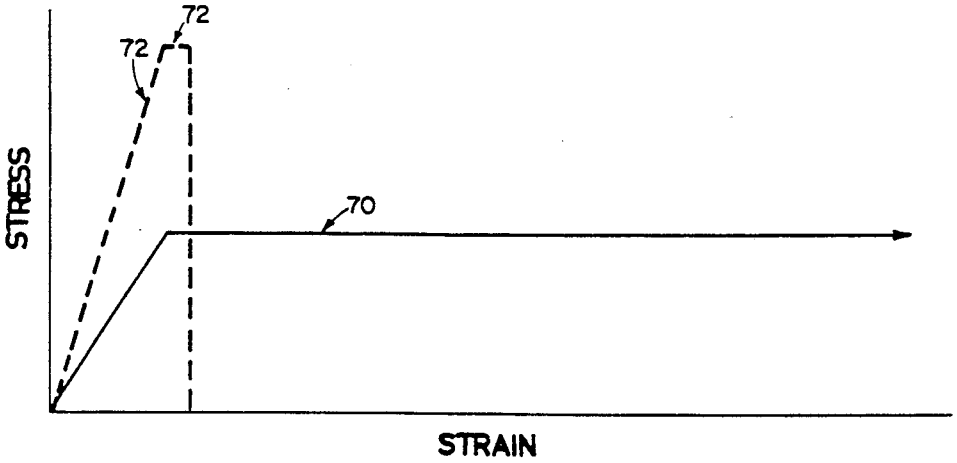
FIG. 6 is a graph illustrating stress/strain characteristics of a survivability enhancement system in accordance with the invention and of an adhesive bonding system.

Stress/strain relationships of hook-loop fastener arrangements subjected to lateral (shear) forces are indicated in the graph of FIG. 6. As indicated by line 70, with hooks 22 (52) engaged with loops 34, the stress/strain relationship of the attachment force is maintained at a high level as a tile 40 is subjected to increasing shear force, loops 34 releasing but hooks 22 (52) picking up adjacent loops 34 and maintaining a high level attachment effect. Thus, the attachment system has energy absorbing characteristics, in contrast with an adhesive, for example, that, as indicated by line 72 in FIG. 6, provides resistance to shear forces up to peak 74 but fails when the adhesive bond is broken and then the tile 40 is no longer fastened to the armor substrate 18.

With reference to FIG. 2, a ballistic missle hit on tile 40A transfers energy to the six surrounding tiles 40B, and each of those immediately adjacent tiles 40B correspondingly transmits energy to the surrounding twelve tiles 40C. The armor system thus provides progressive energy dissipation and maintains substantial integrity of the armor.

Figure 7:
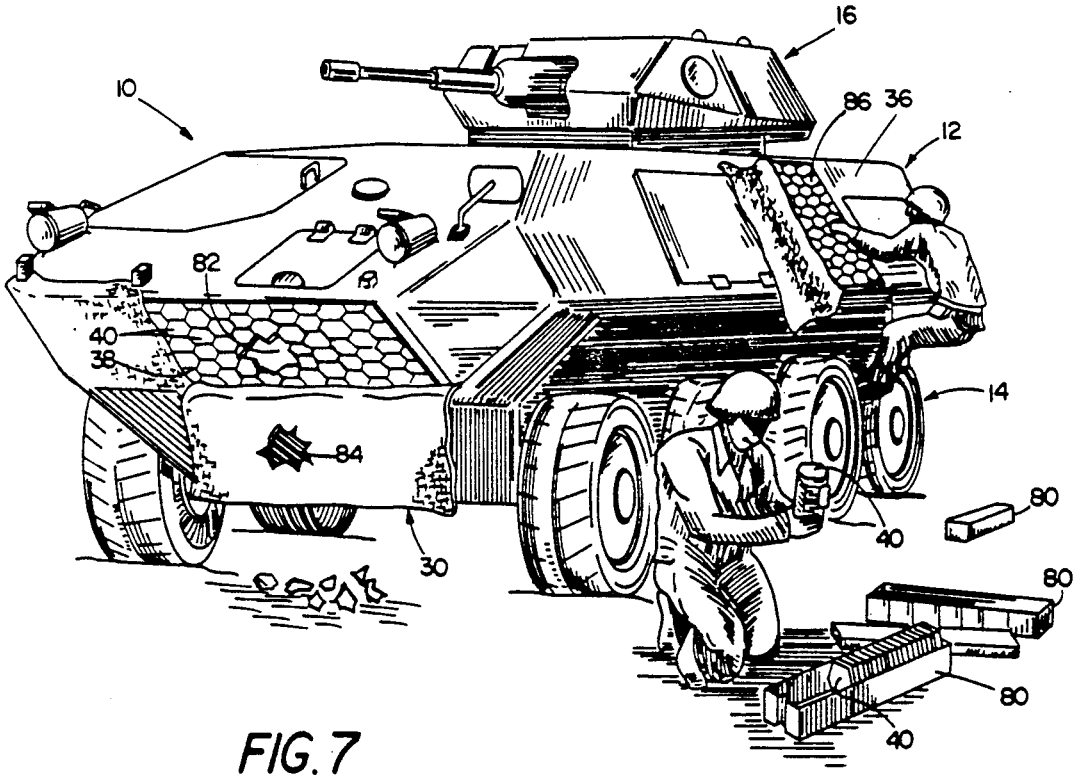
FIG. 7 is a view, similar to FIG. 1, of a light armored vehicle illustrating field replacement of armor tiles.

As indicated in FIG. 7, the armor tiles 40 may be supplied to the field in convenient transport containers 80. The tiles 40 in each container 80 have complementary fastener structures 44, 48 on their opposed surfaces and are readily installed on vehicle 10 in the field. For example, should tile armor 40 on front surface region 38 be damaged as indicated at 82, signature reduction cover 30 may be peeled down, and the damaged tiles removed (as with a pry tool) and replaced with substitute tiles 40 that are secured in place merely by pressing the tile 40 towards hull 12 to engage the complementary fastener structures. After tile replacement, cover 30 is resecured on the outer tile layer also by mere pressing. An auxiliary section of cover structure 30 may be secured over damage region 84 as desired. Similarly, other tiles 40 may be replaced or augmented in the field as indicated, for example, at 86 on side surface 36.

Figure 8:
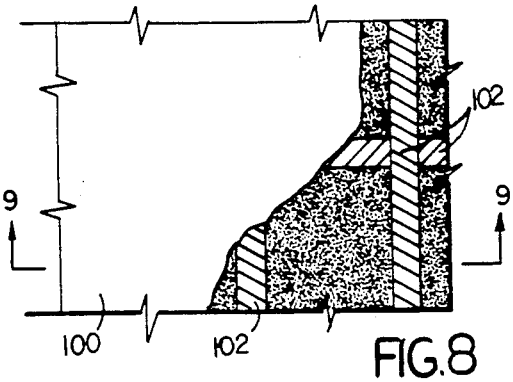
FIG. 8 is an elevational view (with parts broken away) of a spall barrier in accordance with the invention.
Figure 9:
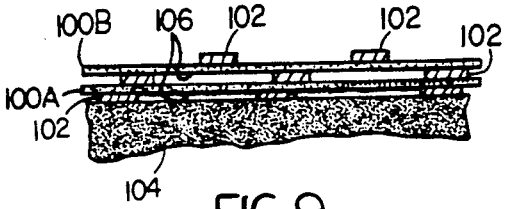
FIG. 9 is a sectional view taken along the line 9—9 of FIG. 8.

A spall barrier system is shown in FIGS. 8 and 9. Spall barrier 100 is a flexible textile mat or mesh composed of fibers such as nylon which are effective under high loading rate conditions including ballistic loading. Hook-type fastener strips 102 are affixed to wall 104 and loop-type fastener structure 106 are sewn onto the inside surface of the flexible spall barrier 100. The loops of fastener structure 106 are not fixed to the backing material but rather are able to be pulled through the backing material and thus absorb relatively large amounts of energy as the loops elongate as the fibers are pulled through the backing materials. Plural flexible mat members 100A, 100B, as indicated in FIG. 9, may be employed, each layer member having hook-type fastener strips 102 on one surface and loop-type fastener structure 106 on the opposite surface.

Suitable adhesives for bonding fastener strips 102 to concrete wall 104 include brittle epoxies and polyesters and flexible adhesives such as silicones and rubber modified polysulfides or polyurethanes.

Figure 10:
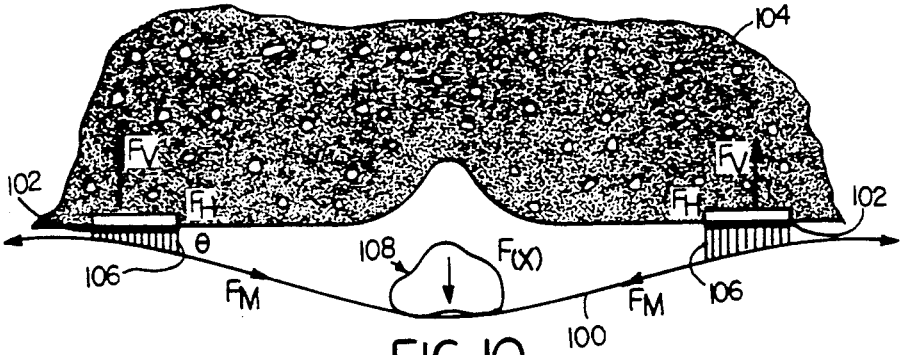
FIG. 10 is a diagrammatic view showing energy absorption aspects of the spall liner system of FIGS. 8 and 9

As can be seen from FIG. 10, spall fragment 108 initially does work stretching barrier 100. However, unlike an adhesively bonded barrier, the fragment 108 also does work in dragging the barrier 100 across the fastener structure 102 in shear ($F_H$) At the same time, additional work is done in stretching the barrier 100.

As $\Theta$ increases, $F_V$ also increases and the work done in peeling apart the hooks 102 and loops 106 begins to predominate. Stress/strain relationships of hook-loop fastener arrangements subjected to lateral (shear) forces are as indicated in the graph of FIG. 6. Energy is dissipated through friction as the long fibers of the loops 102 are pulled through the woven backing. The fibers remain attached, bridging the gap between the backing material over quite a large distance and flattening the peel stress distribution in the joint so that it is nearly uniform in much the same way as a very thick layer of elastomeric adhesive.

As a result, the peel strength is high and is equivalent to the flat-wise tensile strength, which for adhesives is typically 2,000 to 5,000 psi. Even though the fastener strips 102 are bonded to the wall 104 using an adhesive, this adhesive will not fail because it is loaded in flat-wise tension instead of peel and forces high enough to cause rupture of the barrier 100 are not created.

Figure 11:
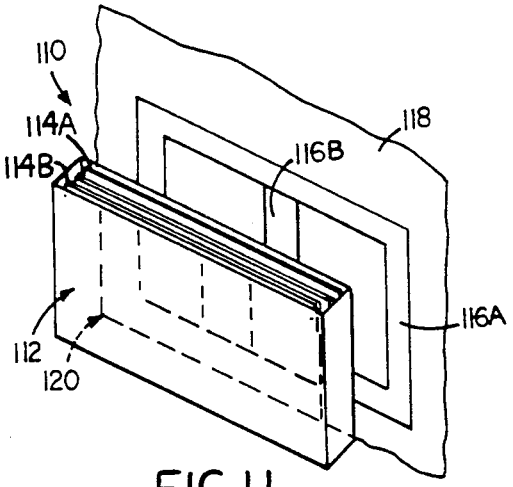
FIG. 11 is an diagrammatic view of an armor installation in accordance with the invention.

Another armor system is shown in FIG. 11. The armor system 110 includes flexible container 112 of high tensile strength material such as nylon in which is disposed a stack of survivability enhancing armor laminate sheets 114. In a particular embodiment, armor laminate 114A includes an array of ceramic armor tiles bonded to a styrofoam sheet with a tensile skin of Kevlar bonded to the opposite surface, and a 'quilt' 114B of six layers of Kevlar sheets. Two inch wide strips 116 of nylon hook-type fasteners are affixed to aluminum wall 118 (including perimeter strips 116A and intermediate strips 116B) and four inch wide strips 120 of nylon filament loop-type fasteners (strips 120 providing mismatch compensation) are sewn in corresponding locations onto the outside rear surface 122 of container 112. Stress/strain relationships of hook-loop fastener arrangements subjected to lateral (shear) forces in response to a ballistic projectile impinging on the exterior surface of wall 118 are similar to those indicated in the graph of FIG. 6.

Figure 12:
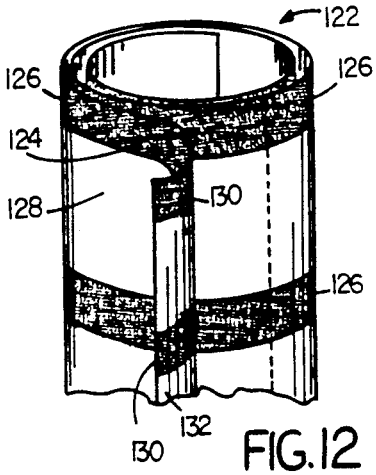
FIG. 12 is an diagrammatic view of portions of a blast confinement container in accordance with the invention, end caps not being shown.

A blast container system is diagrammatically shown in FIG. 12 and includes end caps (not shown). The cylindrical wall of container 122 is formed of a flexible sheet 124 of high tensile strength material such as reinforced Kevlar fibers with strips 126 of hook-type fasteners affixed to one surface 128 and strips 130 of loop-type fasteners affixed to the opposite surface 132. Sheet 124 is wound in a spiral such that surfaces 128 and 132 mate with fasteners 126, 130 in engagement. A blast loading internal to container 122 causes a step increase in hoop stress and the effective radius of curvature of container 122 tends to increase, with the two surfaces 128, 132 in shear that is resisted by the engaged fasteners 126, 130. The hoop stress, if greater than the ultimate yield of the separable fastener treated surfaces 128, 132, will cause opposed movement of the surfaces. This results in an increase in the diameter along with substantial dissipation of blast energy. The increase in the diameter/volume also has a mitigating effect on the load. Stress/strain relationships of hook-loop fastener arrangements subjected to lateral (shear) forces in response to the blast loading are similar to those indicated in the graph of FIG. 6. Movement and energy absorption of the separable fastener treated surfaces continue until such time as the forces balance, thus confining the blast.

This attachment technology greatly simplifies the logistics associated with damage repair. In the case of armor tiles or sheets (either individually or with containers, the tiles, sheets or containers can be rapidly replaced when using hook and loop structures. In the case of concrete spall, the spall barrier can be pressed back into place—barrier loops engaging grid-work hooks not lost to spall—resulting in a serviceable protective shield.

Particular survivability enhancement systems incorporate armor tile arrays or flexible sheet structures with fastener structure that provides energy absorption and attachment that is maintained when exposed to large shear forces resulting, for example, from detonation of an explosive missle on an adjacent armor tile. Forces applied to adjacent tiles may be adjusted as a function of the fastening system and are moderated by energy transfer to adjacent tiles and by the high sliding resistance of the fastener structures while not exceeding tensile or compression limits of the armor tiles or the flexible sheet members.

While particular embodiments of the invention has been shown and described, various modification thereof will be apparent to those skilled in the art, and therefor, it is not intended that the invention be limited to the disclosed embodiments or to details thereof, and departures may be made therefrom within the spirit and scope of the invention.

What is claimed is:

1. A survivability enhancement system having energy absorbing and progressive energy dissipation characteristics and comprising survivability enhancement structure including flexible ballistic protection mat structure of textile-type material in the nature of a spall liner, said mat structure having a surface corresponding to cooperating surface structure.

separable fastener structure of a first type is fixed on an interior wall surface of said cooperating surface structure, and separable fastener structure of a second type and complementary to said first type of separable fastener structure secured to said surface of said flexible ballistic protection mat structure, said separable fastener structure of said second type being of strip configuration and sewn onto said surface of said flexible mat structure, one of said separable fastener structures having a multiplicity of hooking elements and the cooperating other fastener structure having complementary structure that is releasably interengageable with said hooking elements, said separable fastener structures in attached relation supporting said mat on said surface of said cooperating structure, and having a tension restraint of at least five psi and a shear restraint of at least ten psi and a stress/strain relationship of the type in which the attached fastener structures tend to release at a controlled force level and reattach as said flexible mat is subjected to increasing shear force to maintain a high level attachment effect.

2. The system of claim 1 wherein said other fastener structure includes an array of loop portions, and each said hooking element includes a stem portion and a head portion that projects laterally from one side thereof, the head portion including an inclined deflecting portion and a latch surface located between said deflecting surface portion and said stem portion for engaging a loop portion of said other fastener structure in fastening relation.

3. The system of claim 1 wherein said flexible mat structure includes a plurality of sheet members in stacked array, each said sheet member having opposed planar surfaces, separable fastener structure of said first type is secured to one planar surface and separable fastener structure of said second type is secured to its opposed planar surface.

4. The system of claim 1 wherein said separable fastener structure of said second type includes backing material in flexible sheet form and a multiplicity of loop portions protruding from said backing material.

5. The system of claim 4 wherein said separable fastener structure of said first type includes an integral member of molded thermoplastic polymeric material that includes said hooking elements and a base portion, and said base portion is secured to said cooperating surface structure.

6. A survivability enhancement system having energy absorbing and progressive energy dissipation characteristics and comprising survivability enhancement structure that has a surface corresponding to cooperating surface structure, separable fastener structure of a first type fixed on said cooperating structure surface, and separable fastener structure of a second type and complementary to said first type of separable fastener structure secured to said surface of said survivability enhancement structure, said separable fastener structure of said second type includes backing material in flexible sheet form and a multiplicity of loop portions protruding from said backing material, said loop portions being formed from relatively long lengths of continuous fibers that extend through in frictionally secured relation to said backing material such that said loop portions absorb relatively large amounts of energy as the loop fibers are pulled through said backing material, resulting in significant peel strength, said separable fastener structures in attached relation supporting said survivability enhancement structure on said surface structure, and having a tension restraint of at least five psi and a shear restraint of at least ten psi and a stress/strain relationship in which the attached fastener structures tend to release at a controlled force level and reattach as said survivability enhancement structure is subjected to increasing shear force to maintain a high level attachment effect.

7. The system of claim 6 wherein said survivability enhancement structure is a flexible mat of textile-type material, said fastener structure of said first type is of strip configuration and is affixed to said cooperating structure surface and said fastener structure of said second type of strip configuration and is sewn onto a surface of said flexible mat.

8. The system of claim 7 wherein said separable fastener structure of said first type is an integral member of molded thermoplastic polymeric material that includes hooking elements and a base portion, and said base portion is secured to said cooperating structure surface.

9. A survivability enhancement system having energy absorbing and progressive energy dissipation characteristics and comprising flexible mat structure of textile-type material in the nature of a spall liner that has a surface corresponding to cooperating surface structure, separable fastener structure of a first type fixed on an interior wall surface of said cooperating structure surface, and separable fastener structure of a second type and complementary to said first type of separable fastener structure secured to said mat structure, said fastener structure of said first type including an integral member of molder thermoplastic polymeric material that includes a base portion and hooking elements secured to said base portion, said base portion being secured to said interior wall surface, and said fastener structure of said second type including backing material in flexible sheet form sewn onto a surface of said flexible mat structure and a multiplicity of loop portions formed from relatively long lengths of continuous fibers that extend in frictionally secured relation through said backing material such that said loop portions absorb relatively large amounts of energy as the loop fibers are pulled through said backing material, resulting in significant peel strength, said hooking elements and loop portions in attached relation supporting said flexible mat structure on said surface structure, and having a tension restraint of at least five psi, a shear restraint of at least ten psi and stress/strain relationship of the type in which the attached hooking elements and loop portions tend to release at a controlled force level and reattach as said flexible mat structure is subjected to increasing shear force to maintain a high level attachment effect.

10. The system of claim 9 wherein each said hooking element includes a stem portion and a head portion that projects laterally from one side thereof, the head portion including an inclined deflecting portion and a latch surface located between said deflecting surface portion and said stem portion for engaging a loop portion of said other fastener structure in fastening relation.

* * * * *